US006023517A

United States Patent [19]

Ishige

[11] Patent Number: 6,023,517

[45] Date of Patent: Feb. 8, 2000

[54] DIGITAL HEARING AID

[75] Inventor: Ryuuichi Ishige, Tokyo, Japan

[73] Assignee: NEC Corporation, Tokyo, Japan

[21] Appl. No.: 08/955,454

[22] Filed: Oct. 21, 1997

[30] Foreign Application Priority Data

Oct. 21, 1996 [JP] Japan ..... 8-277918

[51] Int. Cl.[7] ..... H04R 25/00

[52] U.S. Cl. ..... 381/315; 381/312

[58] Field of Search ..... 381/312, 315, 381/316, 317, 321

[56] References Cited

U.S. PATENT DOCUMENTS

| | | | |
|---|---|---|---|
| 4,237,449 | 12/1980 | Zibell | 381/315 |
| 4,689,820 | 8/1987 | Kopke et al. | 381/315 |
| 5,867,581 | 2/1999 | Obara | 381/312 |
| 5,892,836 | 4/1999 | Ishige et al. | 381/316 |

FOREIGN PATENT DOCUMENTS 8-223698 8/1996 Japan .

*Primary Examiner*—Sinh Tran

*Attorney, Agent, or Firm*—Foley & Lardner

[57] ABSTRACT

A digital hearing aid enables a user to distinguish an alarm sound from other environmental sound. The hearing aid includes a control unit for determining amplifications for respective frequency band required for acoustic sense compensation on the basis of the result of analysis by an analyzing unit, the hearing characteristics data from a storage unit, and presence and absence of the alarm sound per respective frequency bands from an alarm sound detecting unit for feeding amplification data, and an acoustic sense compensating unit for receiving the input data from an input unit and amplification data from the control unit, for performing an acoustic sense compensating process to increase amplification of the frequency band containing the alarm sound to be greater than those of other frequency bands when the alarm sound contained in a specific frequency band is detected by the alarm sound detecting unit, for outputting.

6 Claims, 12 Drawing Sheets

DIGITAL HEARING AID

BACKGROUND OF THE INVENTION

1. Field of the Invention

The present invention relates a digital hearing aid or hearing aid for perceptive deafness employing a digital signal processing.

2. Description of the Related Art

A hearing impairment, i.e. deafness, is generally classified into two kinds, i.e. conductive deafness and perceptive deafness. The conductive deafness is a hearing impairment caused for variation of transmission characteristics due to failure of any one or all of auris externa, auris media, fenestra cochleae, and fenestra ovalis. This type of hearing impairment can be simply overcome by amplifying input sound. On the other hand, the perceptive deafness is a hearing impairment which is considered to be caused by organic failure in a certain portion from auris interna to cortical auditory area, and represents a condition causing difficulty in perceiving sound due to abnormality of auris interna or so forth. Such difficulty of perceiving sound can be caused by dropout of stereocilium at the tip end of hair cell of the cochlea or by failure of a nerve transmitting voice. Also, senile deafness is involved in this type of deafness. The perceptive deafness is difficult to overcome by the conventional hearing aids which simply amplify sounds. In recent years, attention has been attracted to a digital hearing aid which can perform complicated signal processing.

There is a significant difference of symptom of perceptive deafness in each individual. One primary symptom of perceptive deafness is recruitment of loudness. This is the phenomenon to raise a minimum level (minimum audible threshold: HTL) and to maintain a maximum level (maximum audible threshold: UCL) as substantially unchanged, to thereby narrow an audible range (audible area), as shown in FIG. 6. Also, the maximum audible threshold is frequently lowered slightly. Namely, this is the phenomenon to cause difficulty in hearing a low level sound but to hear a high level sound in substantially equal level to a person having normal hearing ability. If the sound is audible by the hearing aid for making the low level sound audible, the output sound of the hearing aid upon inputting of high level sound should exceed the maximum audible threshold, to be a discomfortable level to perceive. For this reason, it becomes necessary to amplify low level sound with a high amplification, and to amplify high level sound with a low amplification. It is also one characteristic of perceptive deafness in variation of the hearing acuity per frequency level.

The first prior art taking a measure of the perceptive deafness will be discussed hereinafter. The first prior art has been proposed in Japanese Unexamined Patent Publication No. Heisei 3-284000. In the disclosed technology, a dynamic range of an input sound is compressed into an audible range of the deafness. FIGS. 7(*a*) to 7(*e*) show an acoustic sense compensation method of a hearing aid employing a method disclosed in the above-identified publication. FIG. 7(*a*) is a graph taking an acoustic pressure on the horizontal axis and a loudness on the vertical axis. Acoustic pressure is a physical amount of sound and loudness is a magnitude to be felt by a listener as hearing a sound of certain acoustic pressure, namely sensory amount. In the graph, a solid line represents a relationship between the acoustic pressure and the loudness as heard by a person having healthy or normal acoustic sense, and a broken line represents a relationship between the acoustic pressure and the loudness as heard by a person having deafness. As can be appreciated from FIG. 7(*a*), a sound having a given level of acoustic pressure is heard by people one having healthy acoustic sense and the other having deafness, the person having healthy acoustic sense feels greater magnitude of sound than the person having deafness. When the acoustic pressure to be heard becomes lower than the minimum audible threshold, while the person having healthy acoustic sense can hear the sound, the person having deafness cannot hear. FIG. 7(*b*) shows the acoustic pressure feeling equal loudness level in the person having healthy acoustic sense and the person having deafness. In FIG. 7(*b*), the vertical axis and the horizontal axis respectively represent acoustic pressure level for the person having deafness and acoustic pressure level for the person having healthy acoustic sense. Difference of the sound to be felt at equal level by the person having deafness and the person having healthy acoustic sense increases according to decreasing of the acoustic pressure and decreases according to increasing of the acoustic pressure. In FIG. 7(*b*), the broken line represents the result of comparison of the acoustic pressure level to be heard at equal loudness level between people having healthy acoustic sense. As can be seen, in this case, increasing of the acoustic pressure becomes linear. In FIG. 7(*b*), considering that the acoustic pressure level for the person having healthy acoustic sense is input and the acoustic pressure level for the person having deafness is output, by amplifying an input sound by the hearing aid with taking a difference between the broken line and the sloped line in FIG. 7(*c*) as an amplification, the person having deafness may feel the equal magnitude of the sound as that felt by the person having healthy acoustic sense. FIG. 7(*d*) shows a relationship between amplification to be derived as set forth above, and an input acoustic pressure. As can be seen, when the input acoustic pressure is lower, the amplification becomes greater, and when the input acoustic pressure is higher, the amplification becomes smaller. FIG. 7(*e*) is a conceptual illustration of a method for deriving an amplification of the hearing aid on the basis of the loudness curves of the person having healthy acoustic sense and the person having deafness and magnitude of input sound. In FIG. 7(*e*), the vertical axis represents the loudness level (phon) and the horizontal axis represents the acoustic pressure level (dB) of the input sound. The solid line is a loudness curve of the person having healthy acoustic sense and one-dotted line is a loudness curve of the person having deafness (hereinafter occasionally referred to as "user of hearing aid" or simply as "user"). FIG. 7(*e*) illustrates the magnitude of sound to be heard by the person having healthy acoustic sense and the user of the hearing aid. For example, the sound heard at a level c' by the person having healthy acoustic sense has the acoustic pressure of c, whereas the sound heard at the level c' by the person having deafness has the acoustic pressure of c". Namely, when the sound having the acoustic pressure of c is amplified to have the acoustic pressure of c" to make the person having deafness to hear, the person having deafness may hear the sound in substantially equal level as that heard by the person having healthy acoustic sense. That is, the amplification of the hearing application is that necessary for amplifying the acoustic pressure of c to the acoustic pressure c". In FIG. 7(*e*), both of the vertical axis and the horizontal axis represent logarithmic values. Therefore, the amplification can be derived from the following equation.

$$G=c''-c$$

wherein G is an amplification, c" is the magnitude of sound to be heard by the person having deafness and c is the magnitude of the input sound.

As can be appreciated from the foregoing equation, the amplification becomes greater at greater difference of c" and c.

On the other hand, even when the foregoing measure for the perceptive deafness is taken, narrow audible area of the person having deafness in comparison with the person having healthy acoustic sense is held unchanged, and magnitude of all sound to be heard is unified. Particularly, difficulty is caused in feeling large sound and small sound. As a result, in the output signal provided dynamic range compression process as set forth above, it is difficult to distinguish the input sound which the person having healthy acoustic sense feels significant level, such as horn of an automotive vehicle, a bell sound of a fire alarm box, a siren of police patrol car or the like and so forth, from other input sound. As a measure for such problem, the second prior art has been proposed in Japanese Unexamined Patent Publication No. Heisei 4-148396. In the proposed technology in the above-identified publication, the bell sound of the fire alarm box is noticed to the person having hearing impairment by vibration with employing an oscillator operative in response to actuation of a smoke detector, and a portable vibrator which can be driven and stopped by an output of the oscillator. FIG. 8 shows a general illustration of the system established for this purpose. As shown in FIG. 8, the person having hearing impairment holds the vibrator driven in response to actuation of the smoke detector. When the smoke detector detects occurrence of fire, the oscillator is actuated to drive the vibrator held by the person having hearing impairment. In response to the signal from the oscillator, the vibrator notifies occurrence of fire to the person having hearing impairment in place of the fire alarm box.

In the case of the first prior art, when the acoustic pressure level is low, the input signal is amplified with large amplification and when the acoustic pressure level is high, the input signal is amplified with small amplification. As a result, variation of the input signal becomes smaller to cause difficulty in distinguishing the input signal in a specific frequency band from other environmental input sounds.

On the other hand, in the case of the second prior art, the person having hearing impairment may not detect the alarm when the oscillator generating the signal for the oscillator is not present.

SUMMARY OF THE INVENTION

It is an object of the present invention to provide a hearing aid which can solve the problems in the prior art and thus can enable a person having deafness to easily hear an alarm sound distinguishing from other sounds. It should be noted that the alarm sound includes a horn of an automotive vehicle, a bell sound of a fire alarm box or the like, a siren of an ambulance attendant or the like.

According to one aspect of the present invention, a digital hearing aid comprises:

storage means for storing a hearing characteristics of a user by a fitting device;

input means for inputting an input sound from a microphone and converting the input sound into an input data as a digital data;

analyzing means for deriving acoustic pressure levels per respective frequency bands of the input data;

a band-pass filter group dividing the input data into respective frequency components;

alarm sound detecting means for detecting whether an alarm sound is contained in the input data or not on the basis of a waveform pattern or the like in respective frequency bands of the input data past through the filter group;

control means for determining amplifications for respective frequency band required for acoustic sense compensation on the basis of the result of analysis by the analyzing means, the hearing characteristics data from the storage means, and presence and absence of the alarm sound per respective frequency bands from the alarm sound detecting means for feeding amplification data; and acoustic sense compensating means for receiving the input data from the input means and amplification data from the control means, for performing acoustic sense compensating process to increase amplification of the frequency band containing the alarm sound to be greater than those of other frequency bands when the alarm sound contained in a specific frequency band is detected by the alarm sound detecting means, for outputting.

With the present invention as set forth above, since the alarm sound can be heard by a person having perceptive deafness, with amplifying by a larger amplification than amplification for other sound. Thus, the alarm sound can be distinct from other input sound for the person having perceptive deafness.

In the alternative, according to the present invention, acoustic sense compensating means for receiving the input data from the input means and amplification data from the control means, for performing acoustic sense compensating process on the basis of the input data and the hearing characteristics data from the storage means, and thereafter superimposing an alarm sound generated by an alarm sound generating means when the alarm sound is generated by the alarm sound generating means, for outputting.

In another alternative, acoustic sense compensating means for receiving the input data from the input means and amplification data from the control means, for performing acoustic sense compensating process on the basis of the input data and the hearing characteristics data from the storage means, and thereafter superimposing the alarm sound generated by the alarm sound generating means with emphasizing the alarm sound by increasing amplification of the frequency band of the alarm sound and decreasing amplifications of other frequency bands, when the alarm sound contained in the input data is detected by the alarm sound detecting means, for outputting.

In a further alternative, acoustic sense compensating means for receiving the input data from the input means and amplification data from the control means, for performing acoustic sense compensating process on the basis of the input data and the hearing characteristics data from the storage means, and thereafter superimposing the alarm sound generated by the alarm sound generating means with emphasizing the alarm sound by increasing amplification of the frequency band of the alarm sound and decreasing amplifications of other frequency bands, when the alarm sound is generated by the alarm sound generating means, for outputting.

In a yet further alternative, acoustic sense compensating means for receiving the input data from the input means and amplification data from the control means, for performing acoustic sense compensating process on the basis of the input data and the hearing characteristics data from the storage means, and thereafter adding an alarm voice generated by an alarm voice generating means with emphasizing the alarm sound by increasing amplification of the frequency band of the alarm sound and decreasing amplifications of other frequency bands, when the alarm voice is generated by the alarm voice generating means, for outputting.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscuring the present invention.

Figure 1:
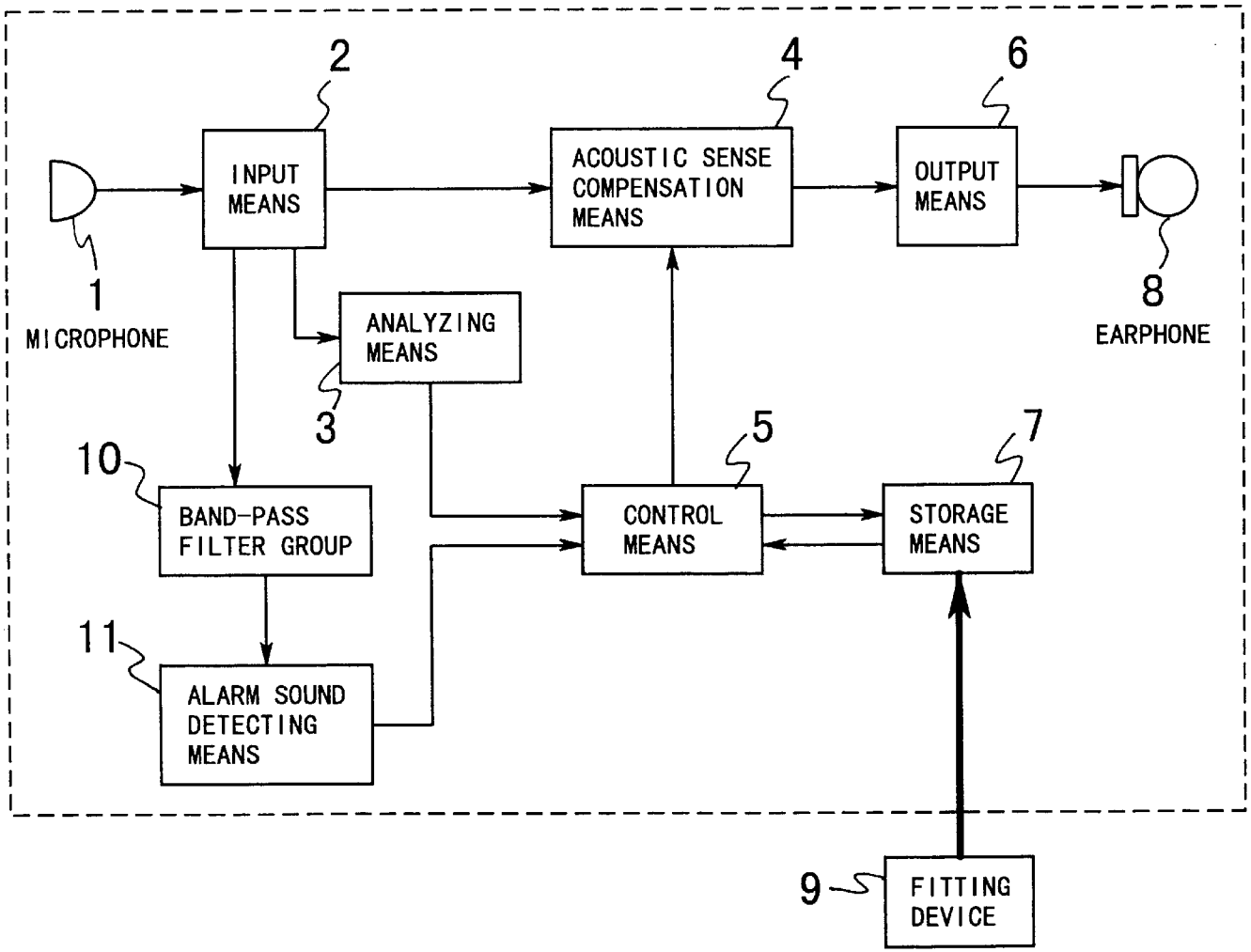
FIG. 1 is a block diagram showing the first embodiment of a digital hearing aid according to the present invention.

The first embodiment of a digital hearing aid according to the present invention will be discussed hereinafter with reference to FIG. 1. The first embodiment of the digital hearing aid of the present invention is adapted for a user having deafness. Therefore, a normal hearing sense compensation process is performed with a large amplification for a small input sound and with a small amplification for a large input sound to compress the dynamic range of the input sound into an audible area of the user narrower than that of the person having healthy acoustic sense. Variation characteristics of the amplification to be employed in the acoustic sense compensation process is differentiated per frequency bands similarly to the hearing characteristics of the user so that the amplification is determined depending upon the magnitude of the input sound and the hearing characteristics of the user.

However, in this method, the magnitude of the output signal can be unified to make variation of level of the sound smaller. Therefore, in the first embodiment of the present invention, the input signal is applied to a plurality of band pass filters to input an output through the filters to an alarm sound detecting portion to check whether an alarm sound is contained in the input sound. If no alarm sound is contained in the input sound, the input sound is amplified per each of the frequency bands by the amplifications determined on the basis of the acoustic pressure level of the input sound and the hearing ability level of the user for outputting. On the other hand, when the alarm sound is contained in the input sound, the amplification of the frequency band corresponding to the alarm sound is set greater than that determined on the basis of the acoustic pressure level of the input sound and the hearing ability level of the user. However, the level of the amplified alarm sound is limited so as not to exceed the UCL (maximum audible threshold) of the user.

In the shown embodiment, hearing characteristics of the user are preliminarily stored in a storage means 7 in the hearing aid by a fitting device 9. The input sound picked up by a microphone 1 is converted into digital data by an input means 2 (which data will be hereinafter referred to as "input data"). The input data is buffered by the input means 2 as required and fed to an analyzing means 3, an acoustic sense compensating means 4, and a band-pass filter group 10. In the analyzing means 3, the input data is analyzed by FFT (Fast Fourier Transform) or so forth. The analyzing means 3 transfers the result of analysis to a control means 5. On the other hand, the input data fed to the band-pass filter group 10 is divided into respective frequency band components and then fed to an alarm sound detecting means 11. In the alarm sound detecting means 11, a check is performed as to whether an alarm sound is contained in the input sound on the basis of the acoustic pressure levels and waveform patterns at respective frequency bands and so forth. The alarm sound detecting means 11 feeds a result to the control means 5. The control means determines amplifications for respective frequency bands required in the acoustic sense compensating means 4 on the basis of the result of analysis of the input data, the heating data characteristics data of the user, presence or absence of the alarm sound, to feed the data indicative of the determined amplification to the acoustic sense compensating means 4. The acoustic sense compensating means 4 receiving the input data and the amplification data performs acoustic sense compensation process for the input data to feed a processed input data to an output means 6. In the output means 6, the processed input data is converted into an analog data to be output through an earphone 8.

Figure 2:
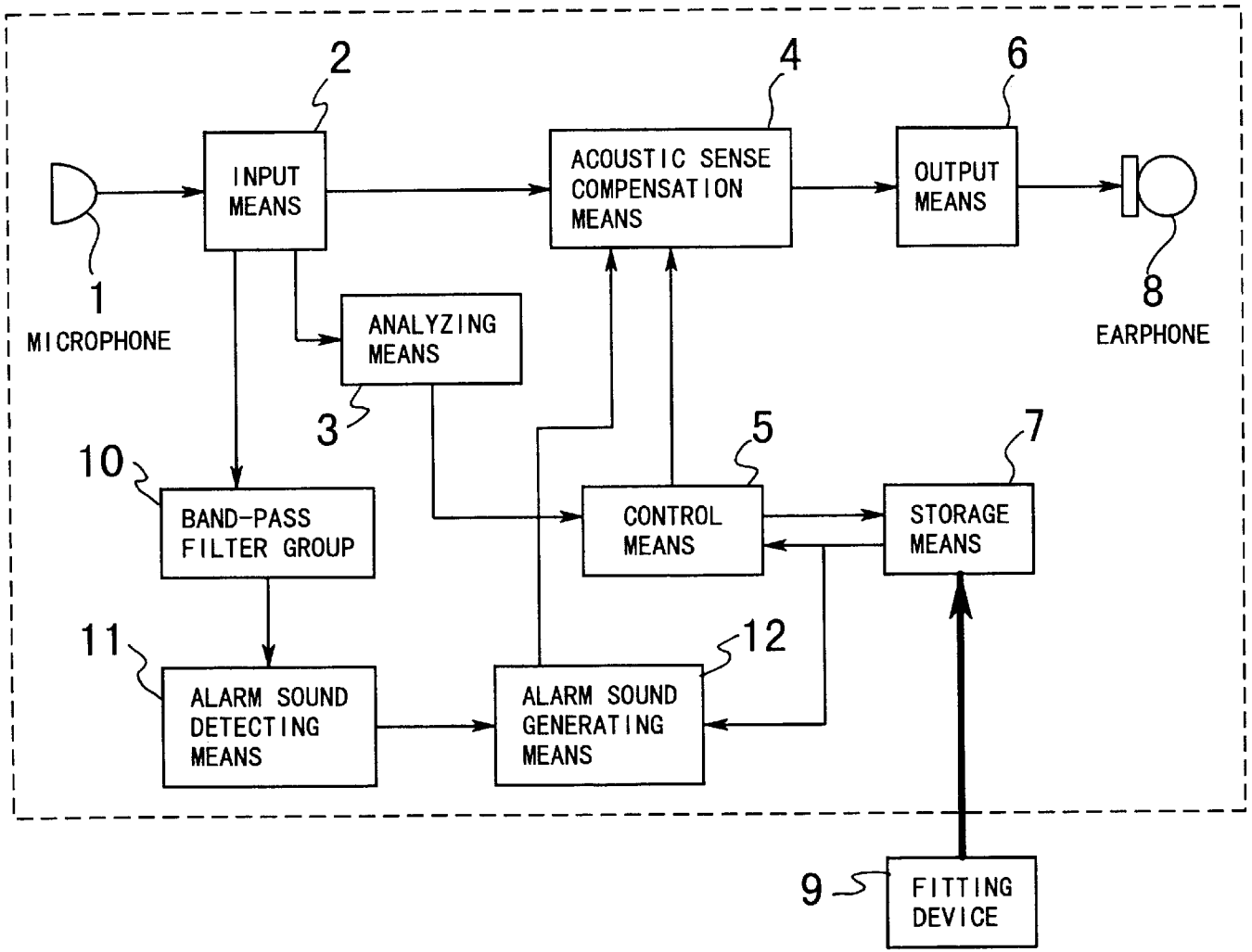
FIG. 2 is a block diagram showing the second embodiment of a digital hearing aid according to the present invention.
Figure 3:
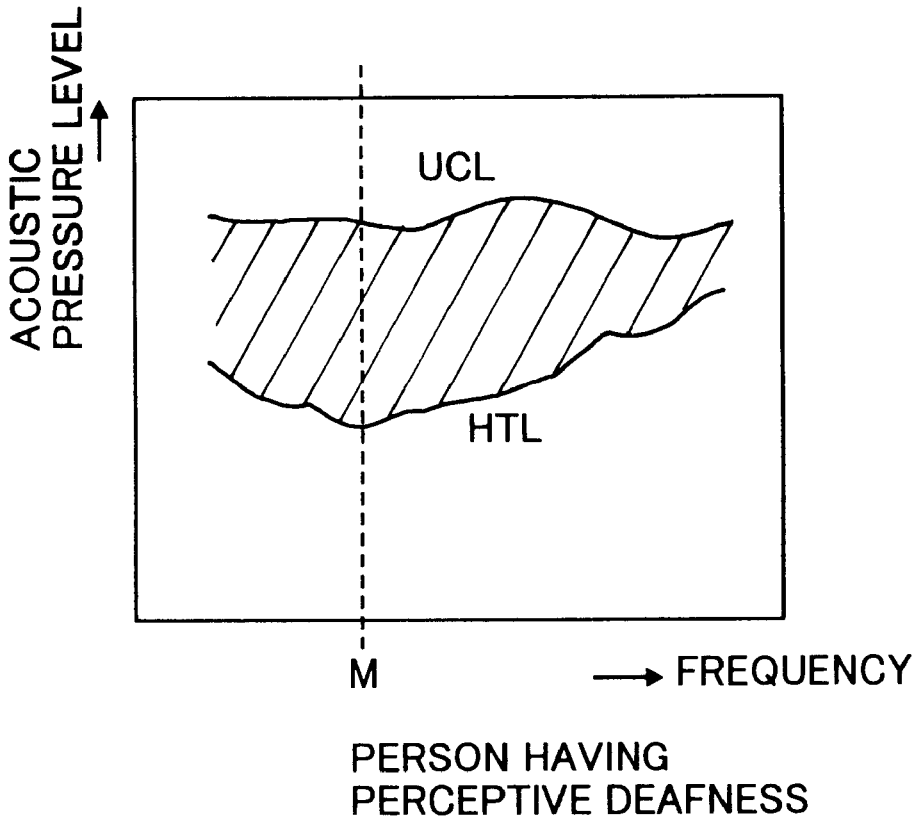
FIG. 3 is a chart showing a hearing characteristics of a user in the second embodiment of the hearing aid of the invention.

Next, discussion for the second embodiment of the digital hearing aid according to the present invention will be given with reference to FIGS. 2 and 3. In the shown embodiment, in addition to the construction of the first embodiment as set forth above, an alarm sound generating means 12 is provided. When an alarm sound is contained in the input sound, the alarm sound generating means 12 generates an alarm sound in the frequency band where the user has high acoustic sense on the basis of the hearing ability data of the user obtained from the storage means 12 to feed to the acoustic sense compensating means 4. The acoustic sense compensating means 4 superimposes the alarm sound generated by the alarm sound generating means 12 on the input data processed by the acoustic sense compensating process. The input data superimposed the alarm sound is converted into analog data by the output means 6 and output through the earphone 8. An example of the alarm sound to be generated by the alarm sound generating means 12 is shown in FIG. 3. It should be noted that, in FIG. 3, HTL is the minimum audible threshold of the user, and M is the frequency at which the user has highest acoustic sense.

Figure 4:
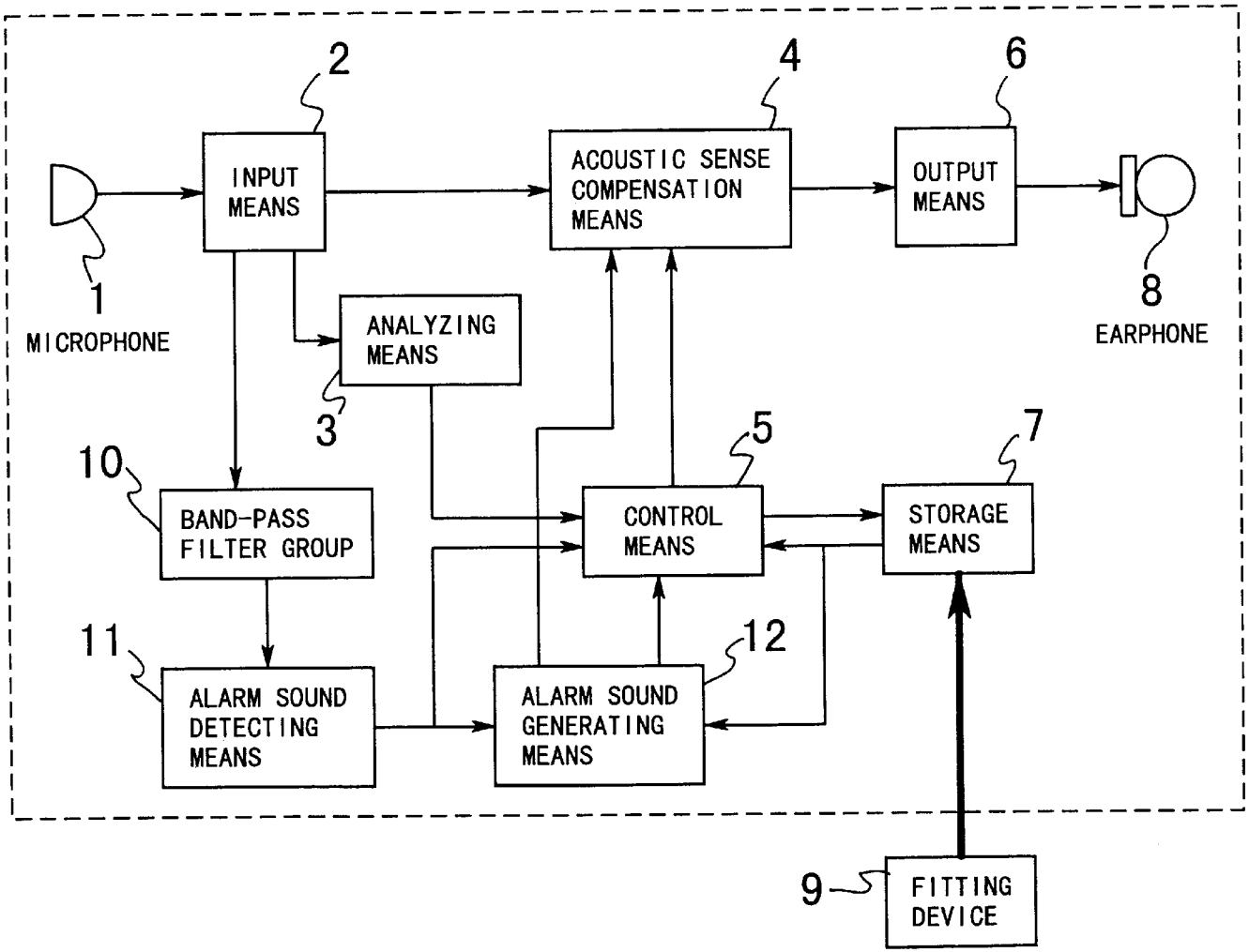
FIG. 4 is a block diagram showing the third embodiment of a digital hearing aid according to the present invention.

Next, the third embodiment of the digital hearing aid according to the present invention will be discussed with reference to FIG. 4. In the shown embodiment, in addition to the constructions of the first and second embodiments as set forth above, information indicative of the frequency band of the alarm sound contained in the input signal from the alarm sound detecting means 11 or the alarm sound generating means 12 or the frequency band of the alarm sound generated by the alarm sound generating means 12 is fed to the control means 5. As set forth above, the control means 5 originally designed to make the amplification to be used in the acoustic sense compensation process to be determined depending upon the acoustic pressure level of the input sound and the hearing ability level of the user, makes the amplification for the frequency band containing the alarm sound greater and the amplifications of remaining frequency band smaller. The amplifications thus determined by the control means 5 are fed to the acoustic sense compensating means 4 for performing the acoustic sense compensating process. When an alarm sound is generated in the hearing aid, the alarm sound is superimposed on the processed input sound. The input data thus processed is converted into analog data by the output means 6 to be output through the earphone 8.

Figure 5:
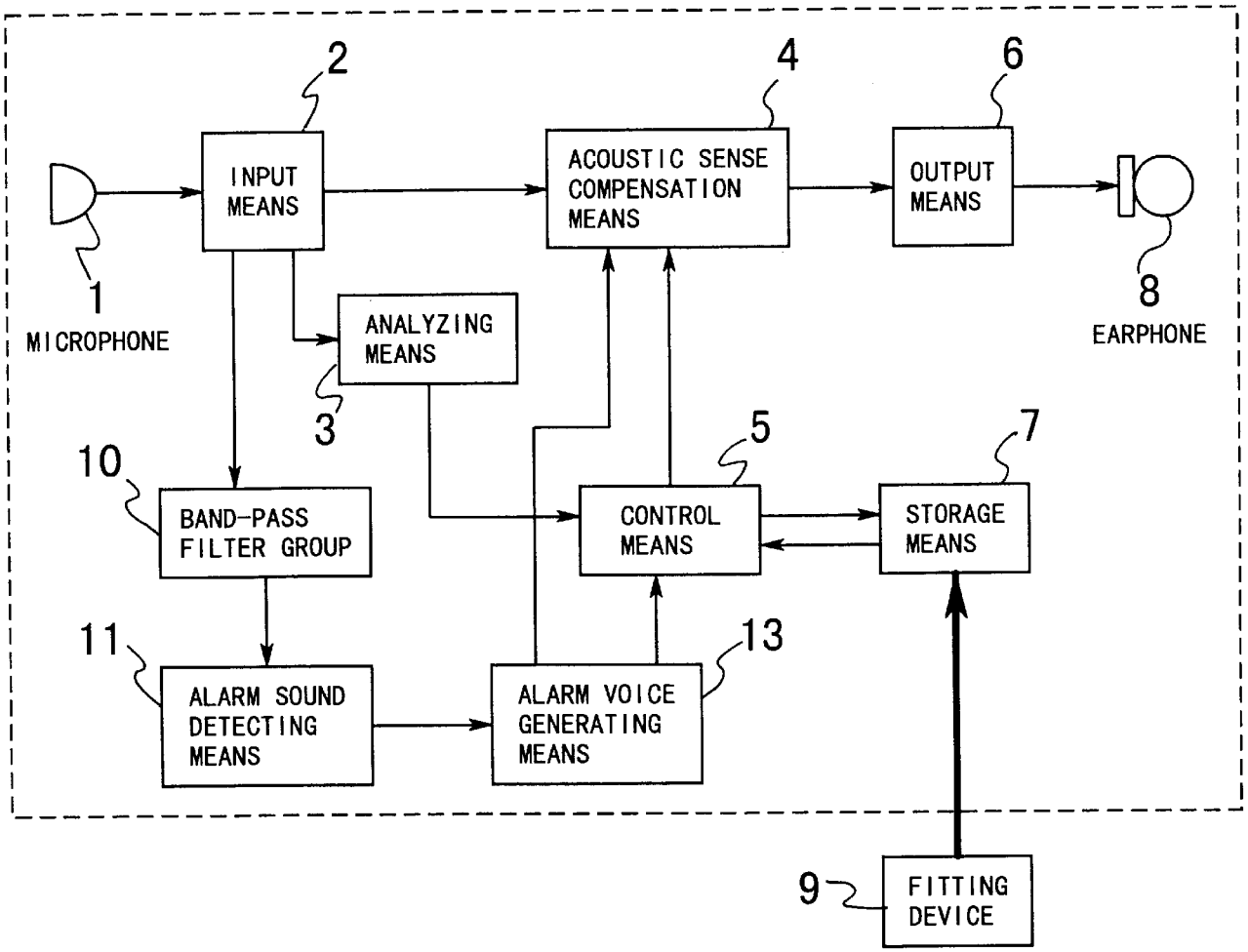
FIG. 5 is a block diagram showing the fourth embodiment of a digital hearing aid according to the present invention.
Figure 6:
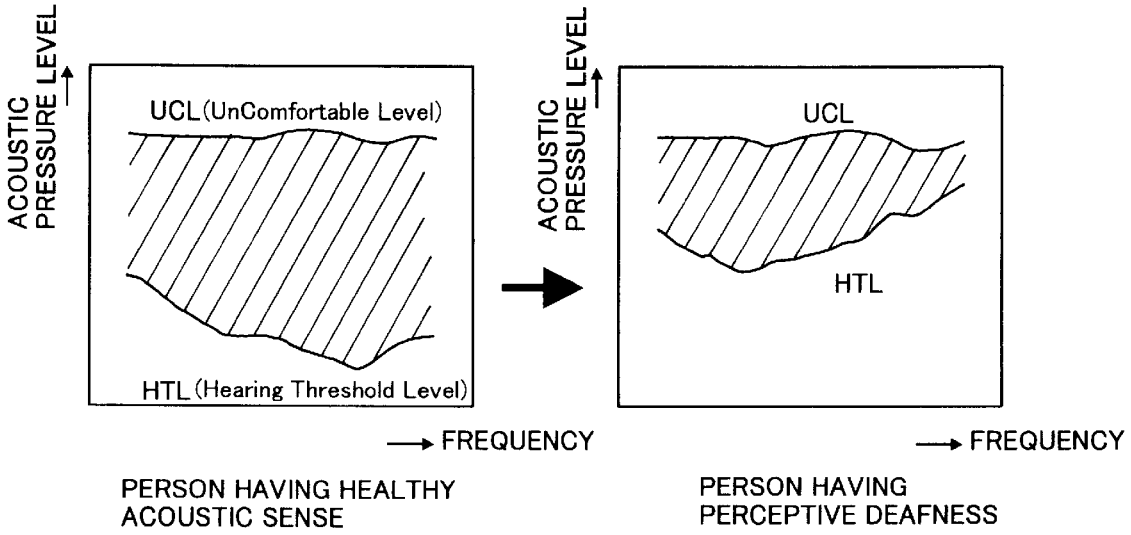
FIG. 6 PRIOR ART
FIG. 6 is an imaginary illustration for explaining perceptive deafness.
Figure 7A:
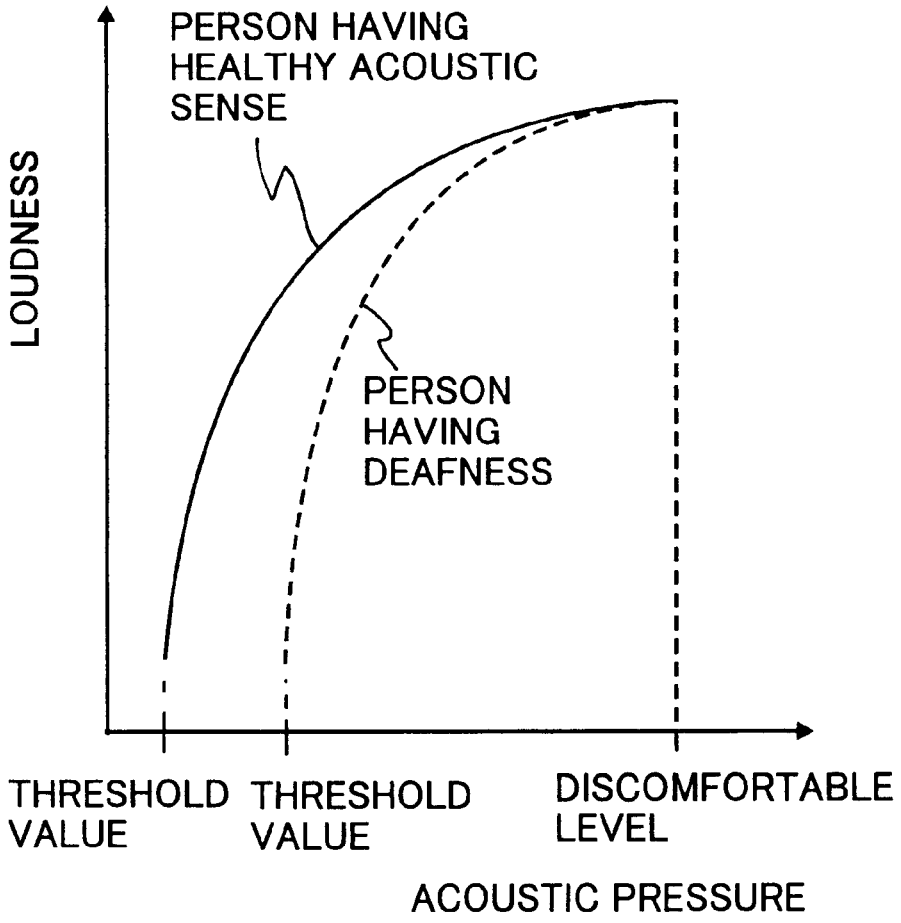
FIG. 7(a) PRIOR ART
FIGS. 7(*a*) to 7(*e*) are illustration for explaining the first prior art.
Figure 7B:
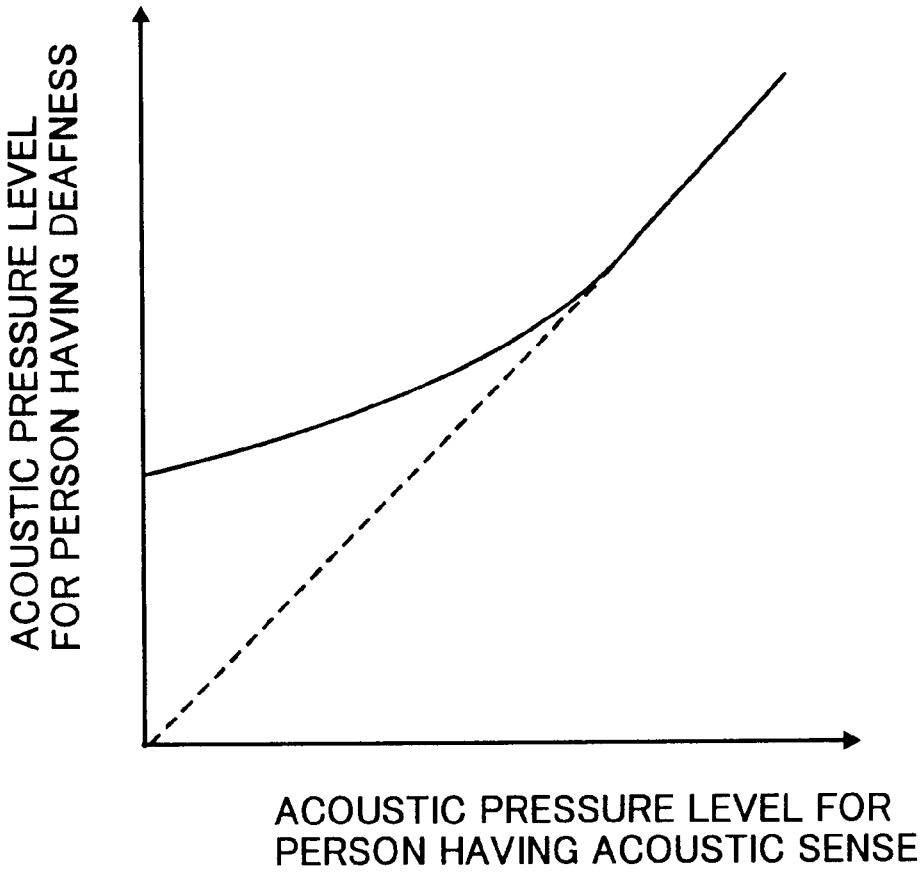
FIG. 7(b) PRIOR ART
Figure 7C:
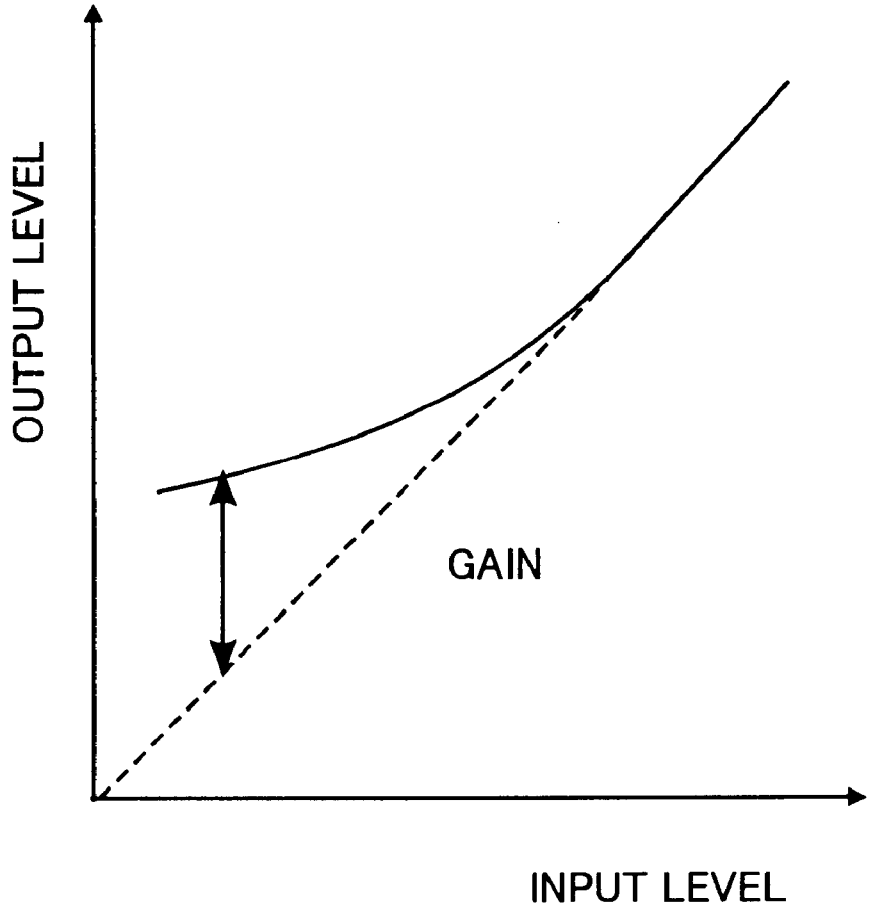
FIG. 7(c) PRIOR ART
Figure 7D:
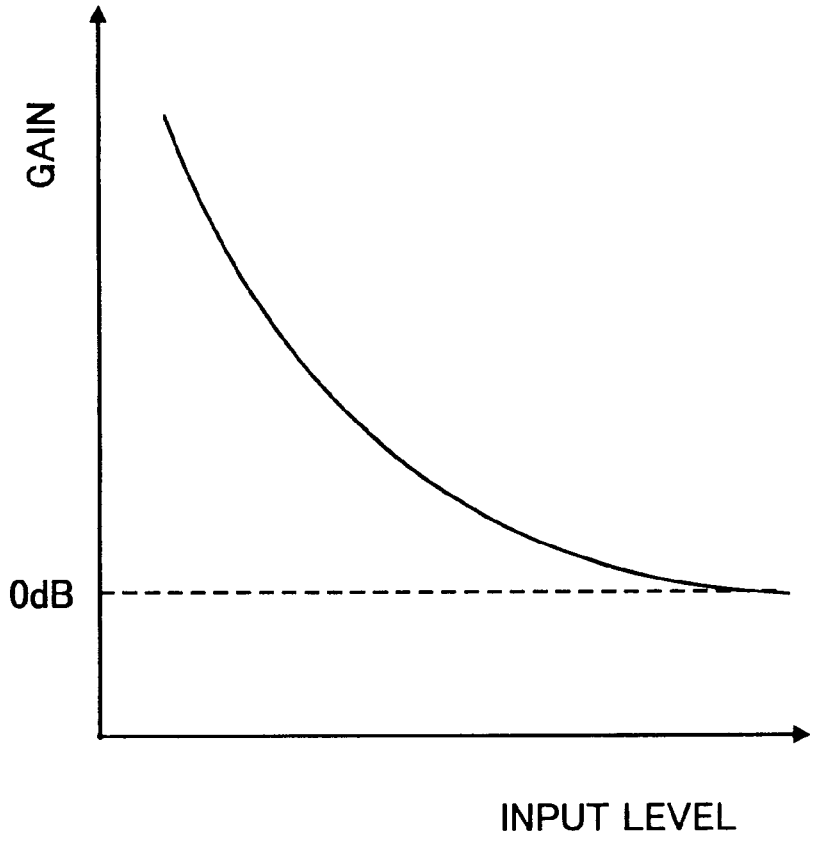
FIG. 7(d) PRIOR ART
Figure 7E:
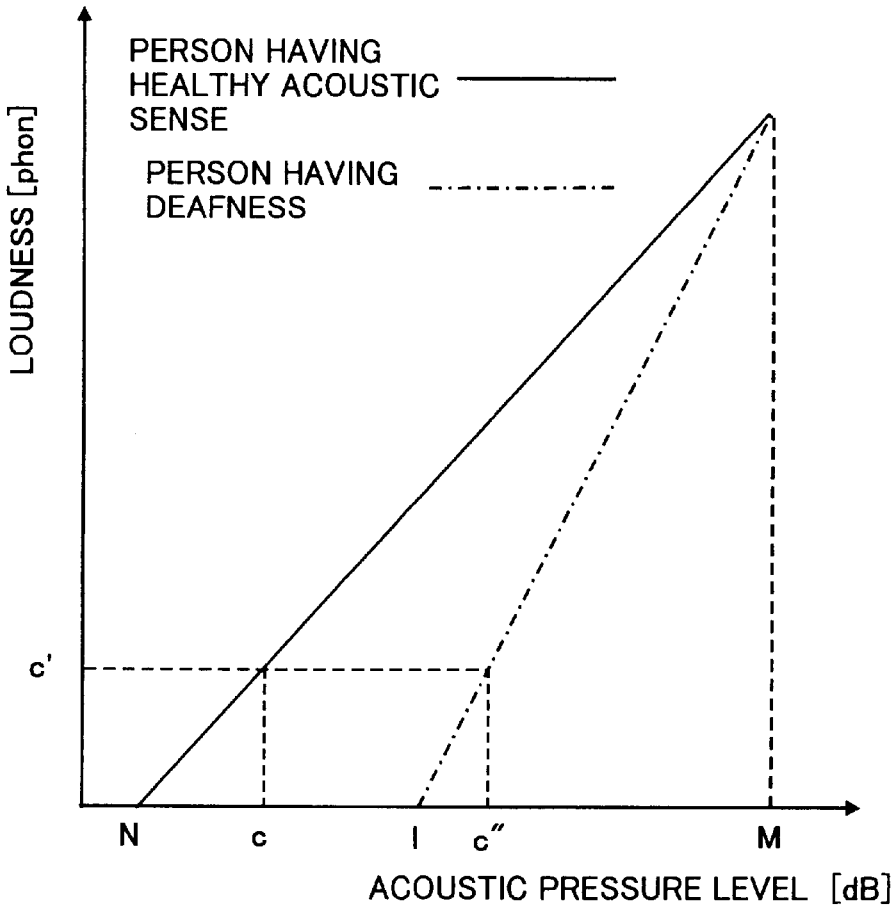
FIG. 7(e) PRIOR ART
Figure 8:
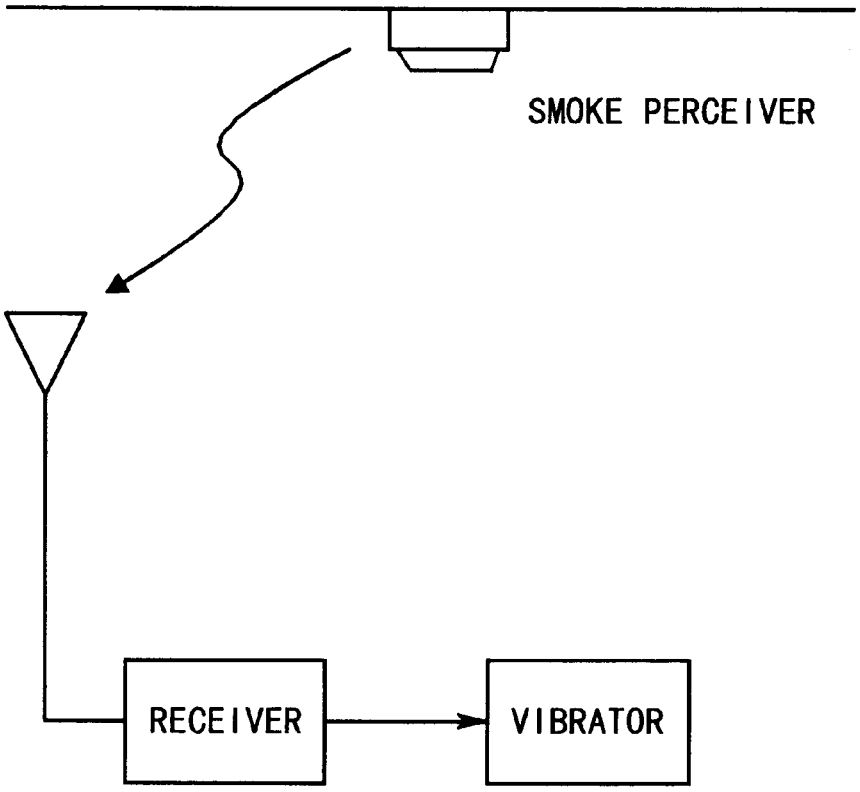
FIG. 8 PRIOR ART
FIG. 8 is an illustration for explaining the second prior art.

Next, the fourth embodiment of the digital hearing aid of the present invention will be discussed with reference to FIG. 5. In the shown embodiment, in addition to the first, second and third embodiments, when the input signal containing the alarm sound is detected by the alarm sound detecting means 11, an announcement indicating that the alarm sound is input is generated by an alarm voice generating means 13. The announcement is fed to the acoustic sense compensation means 4. On the other hand, the amplification of the frequency band of the voice alarm announcement generated by the hearing aid is increased and the amplifications for other frequency bands are decreased. The acoustic sense compensating means performs acoustic sense compensating process on the basis of the amplifications determined by the control means so that the voice alarm announcement generated by the alarm voice generating means 13 is superimposed and output. The data thus generated is converted into the analog data by the output means 6 through the earphone 8.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

What is claimed is:

1. A digital hearing aid comprising:

storage means for storing hearing characteristics data of a user by a fitting device;

input means for inputting an input sound from a microphone and converting said input sound into input data as digital data;

analyzing means for deriving acoustic pressure levels per respective frequency bands of said input data;

a band-pass filter group dividing said input data into respective frequency components;

alarm sound detecting means for detecting whether an alarm sound is contained in said input data or not on the basis of a waveform pattern in respective frequency bands of said input data passed through said filter group;

control means for determining amplifications for respective frequency bands required for acoustic sense compensation on the basis of the result of analysis by said analyzing means, the hearing characteristics data from said storage means, and presence or absence of the alarm sound per respective frequency bands from said alarm sound detecting means for feeding amplification data; and acoustic sense compensating means for receiving the input data from said input means and amplification data from said control means, for performing acoustic sense compensating process to increase amplification of the frequency band containing the alarm sound to be greater than those of other frequency bands when the alarm sound contained in a specific frequency band is detected by said alarm sound detecting means, for outputting.

2. A digital hearing aid comprising:

storage means for storing hearing characteristics data of a user by a fitting device;

input means for inputting an input sound from a microphone and converting said input sound into input data as digital data;

analyzing means for deriving acoustic pressure levels per respective frequency bands of said input data;

a band-pass filter group dividing said input data into respective frequency components;

alarm sound detecting means for detecting whether an alarm sound is contained in said input data or not on the basis of a waveform pattern in respective frequency bands of said input data passed through said filter group;

alarm sound generating means receiving detection data from said alarm sound detecting means for generating an alarm sound of a frequency band, at which the user has the highest acoustic sense on the basis of the hearing characteristics data of the user from said storage means when the alarm sound is contained in said input data;

control means for determining amplifications for respective frequency bands required for acoustic sense compensation on the basis of the result of analysis by said analyzing means, the hearing characteristics data from said storage means, and presence or absence of the alarm sound per respective frequency bands from said alarm sound detecting means for feeding amplification data; and acoustic sense compensating means for receiving the input data from said input means and amplification data from said control means, for performing acoustic sense compensating process on the basis of said input data and said hearing characteristics data from said storage means, and thereafter superimposing said alarm sound generated by said alarm sound generating means when the alarm sound is generated by said alarm sound generating means, for outputting.

3. A digital hearing aid comprising:

storage means for storing hearing characteristics data of a user by a fitting device;

input means for inputting an input sound from a microphone and converting said input sound into input data as digital data;

analyzing means for deriving acoustic pressure levels per respective frequency bands of said input data;

a band-pass filter group dividing said input data into respective frequency components;

alarm sound detecting means for detecting whether an alarm sound is contained in said input data or not on the basis of a waveform pattern in respective frequency bands of said input data passed through said filter group;

control means for determining amplifications for respective frequency bands required for acoustic sense compensation on the basis of the result of analysis by said analyzing means, the hearing characteristics data from said storage means, and presence or absence of the alarm sound per respective frequency bands from said alarm sound detecting means, and the alarm sound generated by said alarm sound generating means when the alarm sound is detected by said alarm sound detecting means, for feeding amplification data; and acoustic sense compensating means for receiving the input data from said input means and amplification data from said control means, for performing acoustic sense compensating process on the basis of said input data and said hearing characteristics data from said storage means, and thereafter superimposing said alarm sound generated by said alarm sound generating means with emphasizing said alarm sound by increasing amplification of the frequency band of said alarm sound and decreasing amplifications of other frequency bands, when the alarm sound contained in said input data is detected by said alarm sound detecting means, for outputting.

4. A digital hearing aid comprising:

storage means for storing hearing characteristics data of a user by a fitting device;

input means for inputting an input sound from a microphone and converting said input sound into input data as digital data;

analyzing means for deriving acoustic pressure levels per respective frequency bands of said input data;

a band-pass filter group dividing said input data into respective frequency components;

alarm sound detecting means for detecting whether an alarm sound is contained in said input data or not on the basis of a waveform pattern in respective frequency bands of said input data passed through said filter group;

alarm sound generating means receiving detection data from said alarm sound detecting means for generating an alarm sound of a frequency band, at which the user has the highest acoustic sense on the basis of the hearing characteristics data of the user from said storage means when the alarm sound is contained in said input data;

control means for determining amplifications for respective frequency bands required for acoustic sense compensation on the basis of the result of analysis by said analyzing means, the hearing characteristics data from said storage means, and presence or absence of the alarm sound per respective frequency bands from said alarm sound detecting means for feeding amplification data; and acoustic sense compensating means for receiving the input data from said input means and amplification data from said control means, for performing acoustic sense compensating process on the basis of said input data and said hearing characteristics data from said storage means, and thereafter superimposing said alarm sound generated by said alarm sound generating means with emphasizing said alarm sound by increasing amplification of the frequency band of said alarm sound and decreasing amplifications of other frequency bands, when the alarm sound is generated by said alarm sound generating means, for outputting.

5. A digital hearing aid comprising:

storage means for storing hearing characteristics data of a user by a fitting device;

input means for inputting an input sound from a microphone and converting said input sound into input data as digital data;

analyzing means for deriving acoustic pressure levels per respective frequency bands of said input data;

a band-pass filter group dividing said input data into respective frequency components;

alarm sound detecting means for detecting whether an alarm sound is contained in said input data or not on the basis of a waveform pattern in respective frequency bands of said input data passed through said filter group;

alarm voice generating means receiving detection data from said alarm sound detecting means for generating an alarm voice of a frequency band, at which the user has the highest acoustic sense on the basis of the hearing characteristics data of the user from said storage means when the alarm sound is contained in said input data;

control means for determining amplifications for respective frequency bands required for acoustic sense compensation on the basis of the result of analysis by said analyzing means, the hearing characteristics data from said storage means, and further on the basis of said alarm voice when the alarm voice is generated by said alarm voice generating means for feeding amplification data; and acoustic sense compensating means for receiving the input data from said input means and amplification data from said control means, for performing acoustic sense compensating process on the basis of said input data and said hearing characteristics data from said storage means, and thereafter adding said alarm voice generated by said alarm voice generating means with emphasizing said alarm sound by increasing amplification of the frequency band of said alarm sound and decreasing amplifications of other frequency bands, when the alarm voice is generated by said alarm voice generating means, for outputting.

6. The digital hearing aid as recited in claim 1, wherein the amplification of the frequency band containing the alarm sound is dynamically adjustable based on the amplification data supplied to the acoustic sense compensating means by the control means.

* * * * *